United States Patent [19]

Richmond

[11] 4,107,252

[45] Aug. 15, 1978

[54] MELT SPINNING SYNTHETIC FILAMENTS

[75] Inventor: Michael Hugh Richmond, Sarnia, Canada

[73] Assignee: Polysar Limited, Sarnia, Canada

[21] Appl. No.: 721,232

[22] Filed: Sep. 8, 1976

Related U.S. Application Data

[63] Continuation-in-part of Ser. No. 573,117, Apr. 30, 1975, abandoned.

[30] Foreign Application Priority Data

May 22, 1974 [CA] Canada ..... 200529

[51] Int. Cl.[2] ..... D01D 1/04

[52] U.S. Cl. ..... 264/176 F; 264/210 F

[58] Field of Search ..... 264/210 F; 526/341–352

[56] References Cited

U.S. PATENT DOCUMENTS

| | | | |
|---|---|---|---|
| 2,604,667 | 7/1952 | Hebeler | 264/168 |
| 2,749,330 | 6/1956 | Banes et al. | 264/210 F |

*Primary Examiner*—Jay H. Woo

*Attorney, Agent, or Firm*—Stevens, Davis, Miller & Mosher

[57] ABSTRACT

Synthetic filament is produced by spinning from the melt of an acrylonitrile-containing polymer, such filaments having high tenacity without the need for after-stretching.

5 Claims, No Drawings

MELT SPINNING SYNTHETIC FILAMENTS

This is a continuation-in-part of application Ser. No. 573,117 filed Apr. 30, 1975, now abandoned.

This invention relates to a process for the production of a filament from a molten polymer. In particular, the filament of this process is an acrylonitrile-containing material.

Filaments, and fibres obtained therefrom, made from polymers of acrylonitrile have long been known in the art. Such polymers usually contain at least 75% by weight of acrylonitrile, frequently at least 85%, and most usually 90–99%, of acrylonitrile. Typical monomers copolymerized with the acrylonitrile include vinyl pyridine, styrene, vinyl chloride and vinyl acetate, each monomer when copolymerized with the acrylonitrile causing a change in one or more properties of the filament, such as dyeability. Such acrylonitrile polymers are formed into filaments by spinning from a solution of the polymer in a suitable solvent or from a suspension of the polymer in a suspending agent. They cannot be spun into filaments from the pure molten polymer; it is possible to spin filaments from the molten polymer containing small amounts, from about 5 to about 15 percent, of a suitable plasticizer but this is not a commercially acceptable process nor is it truly spinning from the pure molten polymer. In order to achieve reasonable strength or tenacity in the filament it usually has to be after-stretched, which leads to the development of orientation in the polymer molecules in the filament, the stretching being at an elevated temperature and by at least a 100–200% increase in length, followed by cooling of the filament.

It has now been discovered that a synthetic filament may be produced by spinning from the molten polymer of a solid copolymer of acrylonitrile, styrene and isobutylene. The filament so produced has a high tenacity without the need for being after-stretched.

It is an objective of this invention to provide a process for the production of a synthetic filament which comprises spinning by extruding molten polymer which contains no solvent or plasticizer through a spinneret, in which the polymer is a solid copolymer of acrylonitrile, styrene and isobutylene.

The polymers of this invention which are used to produce the filaments are solid copolymers which contain from 65 to 75 weight % of acrylonitrile, from 12 to 18 weight % of styrene and from 13 to 18 weight percent of isobutylene. Preferably the polymer contains from 66 to 72 weight % of acrylonitrile, from 14 to 17 weight % of styrene and from 14 to 17 weight % of isobutylene. Such polymers are advantageously prepared by a free radical aqueous emulsion polymerization process and recovered from the aqueous phase by conventional coagulation techniques. The recovered water-wet polymer is dried, for example, in a forced-air dryer at a temperature of at least about 180° F. For convenience in subsequent use of the polymer, the product from the dryer may be further treated by passage through a vacuum extruder in order to reduce residual water to a minimum and the extruded product may then be pelletized.

Such polymers are solid thermoplastic materials. Typically they may have a melt index of about 0.2 to about 1 gram per 10 minutes when measured in the standard test for melt index using a load of 2.16 kilograms and a test temperature of 445° F. The melt index is used as a measure of the polymer molecular weight.

In a typical process for the production of polymers used in this invention, isobutylene is emulsified in water in the presence of a suitable emulsifier and the isobutylene emulsion is added to an agitated reactor in which the temperature is maintained at about 100° to about 140° F. A suitable free radical polymerization initiator, such as potassium persulphate, is added. A mixture of acrylonitrile, styrene and molecular weight control agent, such as an organic mercaptan, is added at a slow uniform rate such that a large excess of acrylonitrile monomer is not present in the reactor. An increment addition of the free radical polymerization initiator is desirably added to the reactor at about half the polymerization period in order to maintain the polymerization at a fairly uniform rate throughout the polymerization period. On completion of the polymerization, which is suitably when the conversion of the monomers is greater than about 90%, the polymer latex is added to an aqueous coagulation medium, suitably a solution of calcium chloride, at a temperature of about 160°–200° F and the so-coagulated polymer is separated, washed and dried.

Such a polymer may be used to prepare filaments. Because polymers containing high levels of acrylonitrile tend to absorb moisture on storage, it is desirable to vacuum dry the pelletized polymer immediately prior to forming into filaments. The so dried polymer is then supplied to an extruder for formation into filaments. No solvent or plasticizer is supplied with the polymer or to the extruder. The extruder is operated at a high enough temperature to melt the polymer and to cause good flow of the molten polymer. The product from the extruder exits into a spinning pack filter system before passing to a spinneret which contains a number of small holes of fixed dimension. Such spinnerets are well known in the industry. Temperatures of about 350° F to about 500° F are suitable for the operation of the extruder, spinning pack filter system and spinneret. Preferably, the temperature at which the extruder is operated is from 350° F to 425° F. A preferred temperature range for the operation of the spinning pack filter system is from 400° to 500° F; pressure in the spinning pack filter system will usually be from 1,000 to 3,500 psi and preferably from 2,000 to 3,000 psi. The filaments flowing from the spinneret are cooled, suitably by contact with a cool fluid such as either a cool gas or cool liquid and most suitably by ambient temperature air. The rate of cooling is usually controlled at a uniform rate. The cooled filament is then wound onto a suitable bobbin. This windup process may be used to cause draw-down of the filament or it may be wound up without imparting any stretch to the filament. The windup may be at a constant speed or at a constant tension. When the filament is subjected to draw-down the useful range of draw-down ratios is from about 10:1 to about 100:1 with a preferred range being from about 20:1 to about 50:1. The denier of the filament may range from about 5 up to about 100 or more, depending upon the use to which the final filament is going to be put. The wound up filament may then be handled in a variety of manners depending on the use to be made of the filament. The filament may optionally be subjected to after-stretching, either hot or cold, to enduce a greater degree of orientation within the filament and thereby impart even higher strength, it may be cut into short lengths to form fibres or it may be used directly in a weaving process, either alone or blended with other filaments. The filament produced by the process of this invention has sufficient strength that it may be used without after-stretching either alone or blended with another filament, for instance polypropylene. The polymer herein described may also be alloyed with another filament-forming material such as polypropylene, and the alloy then formed into filaments. The filament of this invention has good elongation properties as shown by good knot tensile strength. The filament has also been found to have good temperature stability as determined by simple ironability tests. The commercial advantages of spinning a filament directly from the melt and without having to recover a solvent are well known in the industry.

Thus the process herein described has two main improvements over the present state of the art associated with filaments derived from acrylonitrile polymers, these being direct spinning from the pure molten polymer and production of a filament having good strength properties without requiring after-stretching.

The following example serves to illustrate the invention and not to limit the scope thereof.

EXAMPLE

Polymer Preparation

A polymer suitable for forming into filaments was prepared by an emulsion polymerization process. To a reactor equipped with inlet means, agitating means and temperature regulating means was added 200 parts by weight of water, 2 parts by weight of the di-sodium salt of a straight chain ethoxylated alcohol half ester of sulfosuccinnic acid, 2 parts by weight of sodium mono alkylphenoxy benzene disulphonate, 0.2 parts by weight of sodium bisulphite and 15 parts by weight of isobutylene. The temperature of the contents of the reactor was raised to 122° F and the agitation means was put into operation. In a separate container was prepared a mixture of 70 parts by weight of acrylonitrile, 15 parts by weight of styrene and 0.5 parts by weight of tertiary dodecyl mercaptan. Also in a separate vessel was prepared a 0.5 weight % solution of potassium persulphate in water. Sufficient potassium persulphate solution was added to the reactor to correspond to 0.5 parts by weight of potassium persulphate. Essentially simultaneously, the addition was started of the acrylonitrile/-styrene/mercaptan mixture, the rate of addition being uniform and such that the addition was complete after a total of 5 hours. At 4 hours from the start of the addition of the acrylonitrile/styrene/mercaptan mixture, an increment of potassium persulphate solution, corresponding to 0.25 parts by weight of potassium persulphate was added to the reactor. The polymerization was stopped at 7 hours after the start of the addition of the polymerizable monomers, the conversion of total monomers to polymer being 92%, an aqueous slurry of an alkylated aryl phosphite was added to the latex in an amount equivalent to 1 part by weight per 100 parts by weight of polymer. The polymer was recovered by adding the latex to a 1% aqueous solution of calcium chloride at a temperature of 190° F and separating off the coagulated polymer which was then water washed and dried in a forced air dryer at a temperature of 180° to 190° F. The so dried polymer was then further dried by being put through a vacuum extruder and the extruded product was pelletized. The polymer was found to contain, by weight, 69% of acrylonitrile, 16% of styrene and 15% of isobutylene. It had a melt index of 0.6 g/10 minutes (2.16 kg load and 445° F temperature).

Filament Preparation

The pelletized polymer was dried in a vacuum oven for 1 hour at 80° C and then fed to an extruder. The experimental filament spinning system contained an extruder having a diameter of 1 inch and an L:D ratio of 25:1 with a three-zone temperature control system on the barrel. The output from the extruder was fed through a valve adapter to a spinning pack containing a 100 mesh screen and into a spinneret having 104 holes of 0.02 inch diameter. The filament from the spinneret was cooled by a stream of room temperature air and was passed to a windup bobbin. The extruder was operated at a screw speed of 18 rpm and at a temperature of 360° F on all three barrel sections and the spinning pack was maintained at 485° F, the pressure in the spinning pack being 2,700 psi. The cooling air was maintained at a pressure of 10 psi and the windup bobbin was run at a speed such that the rate of windup was 48 ft. per minute. Draw-down of the filament from the spinneret was 40 to 1. No solvent or plasticizer was added to the polymer being fed to the extruder.

Filament Properties

The filament so produced had an average denier of 59 and an average diameter of 126 microns. The average tensile strength of the straight filament was 1.9 grams per denier and the elongation to break was 27%. Knotted filament had an average tensile strength of 1.5 grams per denier and an elongation of 16%, showing about 80% retention of the strength at the knot.

The filaments produced in this example were found to show little evidence of sticking to an iron when subjected to conventional ironing at medium temperature settings.

This example shows that a filament having good strength properties, without having undergone after-stretching, is readily produced from the polymer herein described.

The polymer may be alloyed with, for example, polypropylene in the extruder and a filament produced from the alloy. Also the pure filament may be blended with polypropylene filaments for other applications.

What is claimed is:

1. A process of forming a filament which comprises spinning by extruding molten polymer through a spinneret and cooling the so formed filament, characterized in that the molten polymer contains no solvent or plasticizer and that said polymer is a solid copolymer of 65–75 weight percent of acrylonitrile, 12–18 weight percent of styrene and 13–18 weight of isobutylene, the molten polymer and spinneret being at a temperature of about 350° to 500° F.

2. The process of claim 1 wherein the copolymer has a melt index of about 0.2 to about 1 grams per 10 minutes when measured under a load of 2.16 kg and at 445° F.

3. The process of claim 1 wherein the copolymer contains 66 to 72 weight percent of acrylonitrile, 14 to 17 weight percent of styrene and 14 to 17 weight percent of isobutylene.

4. The process of claim 1 wherein the molten polymer is passed from an extruder operated at a temperature of from 350° F to 425° F to a spinning pack filter system operated at a temperature of 400° F to 500° F and a pressure of 1,000 to 3,500 psi and then to a spinneret operated at a temperature of 400° F to 500° F and the so formed filament is cooled by contact with a cool fluid.

5. The process of claim 4 in which the filament is subjected to draw-down within the range of from 10 to 1 to 100 to 1.

* * * * *